US005263569A

United States Patent [19]

Hiramoto et al.

[11] Patent Number: 5,263,569

[45] Date of Patent: Nov. 23, 1993

[54] SUBSTRATE SUPPLY APPARATUS

[75] Inventors: Kouji Hiramoto; Hiromi Kinoshita, both of Kofu; Tadashi Tanno, Yamanashi; Tatsuya Shimoyama, Kofu, all of Japan

[73] Assignee: Matsushita Electric Industrial Co., Ltd., Kadoma, Japan

[21] Appl. No.: 942,169

[22] Filed: Sep. 8, 1992

[51] Int. Cl.[5] ..... B65B 47/00

[52] U.S. Cl. ..... 198/468.4; 29/740; 29/743; 29/759; 414/797

[58] Field of Search ..... 29/740, 741, 743, 759; 198/468.4; 414/797

[56] References Cited

U.S. PATENT DOCUMENTS 4,995,505 2/1991 Takahashi et al. ..... 198/468.4

5,033,185 7/1991 Hidese ..... 29/740

*Primary Examiner*—Carl E. Hall

*Attorney, Agent, or Firm*—Wenderoth Lind & Ponack

[57] ABSTRACT

A substrate supply apparatus includes a substrate-accommodating section for accommodating a substrate on which electronic components are to be mounted, a substrate-width-adjusting device, a transporting device, a substrate-sucking device, and an elevating device. The accommodating section has substrate-width-regulating sections a distance between which can be adjusted in a width direction of the substrate. The adjusting device adjusts the distance between the regulating sections by moving one of the regulating sections in the width direction. The transporting device is supported by the regulating sections, has a pair of rails, is arranged above the accommodating section, and transports the substrate to an electronic component-mounting apparatus. The sucking device has a long substrate-sucking arm and a plurality of short substrate-sucking arms. Each of the substrate-sucking short arms is position-changeably installed on the long substrate-sucking arm. The elevating device supports and vertically moves the sucking device so that the sucking device transfers the substrate to the transporting device. The elevating device is disposed at a center of a space between the pair of rails in the width direction.

3 Claims, 10 Drawing Sheets

SUBSTRATE SUPPLY APPARATUS

BACKGROUND OF THE INVENTION

The present invention relates to an apparatus for supplying an electronic circuit substrate to a machine for mounting an electronic component on the substrate.

An example of the construction and operation of a conventional substrate supply apparatus is described below with reference to FIGS. 7 and 8.

The main body 31 of the substrate supply apparatus comprises a substrate-accommodating section 32, the width of which is adjustable depending on the width of a substrate 43; an elevating device 33 for vertically moving arms 38 for sucking the substrate 43 thereto; and a substrate-transporting device 35 having a pair of rails 39 for transporting the substrate 43. A rail-opening/closing device 36 for adjusting the distance between the rails 39 of the substrate-transporting device 35 is provided in substrate-width-regulating sections 40 and 41 for regulating the width 37 of the substrate-accommodating section 32 depending on the size of the substrate 43. The elevating device 33 for vertically moving the arms 38 is provided on the substrate-width-regulating section 40.

Substrates 43 accommodated in the substrate-accommodating section 32 are sucked by a plurality of the arms 38 which are vertically moved by the elevating device 33, thus moving upward one by one. The rail-opening/closing device 36 opens, namely, enlarges the distance between the rails 39 with the upward movement of the substrate 43 and closes, namely, reduces the distance between the rails 39 after the substrate 43 passes between the rails 39 upwardly. Thereafter, the substrate 43 is placed on the rails 39 and transported to an electronic component-mounting apparatus by the substrate-transporting device 35.

As shown in FIG. 7, each of the arms 38 is fixed to the elevating device 33 by a screw member 50. Since the elevating device 33 is located at one side between the rails 39, namely, at the substrate-width-regulating section 40, each arm 38 radially extends on the above side from the elevating device 33. The positions of the arms 38 can be changed according to the size of the substrate 43. Therefore, the comparatively long arms 38 are required to mount electronic components on the substrate 43 of a large size. It is difficult and takes long to adjust the positions of the arms 38 so as to prevent them from interfering with each other.

In addition, since the elevating device 33 is arranged at the substrate-width-regulating section 40 as shown in FIG. 7, the arms 38 which are moved upward and downward by the elevating means 33 necessarily cross one of the extensions of the rails 39 which is located at the side of the substrate-width-regulating section 40. Therefore, the above rail 39 cannot be extended to the direction shown by reference numeral 42 of FIG. 7 because such an extended rail prevents the arms 38 from smoothly moving upward and downward. Thus, the conventional substrate supply apparatus is incapable of receiving a substrate from an apparatus disposed in the direction shown by the reference numeral 42 of FIG. 7.

SUMMARY OF THE INVENTION

It is an object of the present invention to provide a substrate supply apparatus which it is unnecessary to make the whole arms long so as to easily adjust the positions of the arms in a short period of time and which is capable of extending the rails in both of their longitudinal directions, e.g., extending one rail to the direction shown by reference numeral 42 of FIG. 7.

In accomplishing these and other objects of the present invention, according to one aspect of the present invention, there is provided a substrate supply apparatus comprising:

a substrate-accommodating section for accommodating a substrate on which electronic components are to be mounted, the substrate-accommodating section having substrate-width-regulating sections a distance between which can be adjusted in a width direction of the substrate;

a substrate-width-adjusting means for adjusting the distance between the substrate-width-regulating sections by moving one of the substrate-width-regulating sections in the width direction;

a transporting means, supported by the substrate-width-regulating sections, having a pair of rails, and arranged above the substrate-accommodating section, for transporting the substrate to an electronic component-mounting apparatus;

a substrate-sucking means having a long substrate-sucking arm and a plurality of short substrate-sucking arms, each of the substrate-sucking short arms being position-changeably installed on the long substrate-sucking arm; and an elevating means for supporting and vertically moving the substrate-sucking means so that the substrate-sucking means transfers the substrate to the transporting means, the elevating means being disposed at a center of a space between the pair of rails in the width direction.

According to the above-described construction, the elevating means for supplying the substrate-sucking means is disposed at the center of the space between the pair of rails of the transporting means, and the substrate-sucking means has the long sucking arm and a plurality of short sucking arms which are installed on the long sucking arm like branches. That is, the short sucking arms can extend toward both of the rails from the long sucking arm disposed at the center of the space. Therefore, the short sucking arms do not interfere with each other and are allowed to pivot a large angle. In addition, the mounting positions of the short sucking arms on the long sucking arm can be varied according to the size and configuration of the substrate. Since the sucking arms except for the long sucking arm are short, they are not flexed greatly and as such the lengths thereof are not varied to a great extent. Consequently, an erroneous sucking of the substrate can be reduced compared with conventional substrate supply apparatuses.

Since the elevating means is disposed at the center of the space between the rails, it is possible to extend the rails to their backward and forward directions to connect the substrate supply apparatus with another apparatus disposed in one of the both directions and an electronic component-mounting apparatus disposed in the other of the both directions. Thus, the substrate supply apparatus can receive a substrate transported from the apparatus disposed in the one direction and transport the substrate to the electronic component-mounting apparatus. In this transportation of the substrate, the elevating device moves substrate-sucking device downward to a position below a substrate-transporting path so as to pass the substrate through the substrate-transporting path.

According to another aspect of the present invention, there is provided the substrate supply apparatus described above which further comprises a width-adjusting means, operably connected with the substrate-width-adjusting means, for positioning the elevating means at the center of the space of the substrate-accommodating section in the width direction in unison with an operation for adjusting the distance between the substrate-width-regulating sections of the substrate-accommodating section to a width corresponding to that of the substrate.

By the above construction, the width-adjusting means positions the elevating means at the center of the space of the substrate-accommodating section in the width direction thereof in unison with the operation for adjusting the width of the substrate-accommodating section to a width corresponding to that of the substrate. Therefore, the elevating means can be automatically disposed at a position which is most suitable for sucking the substrate by only adjusting the width of the substrate-accommodating section.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
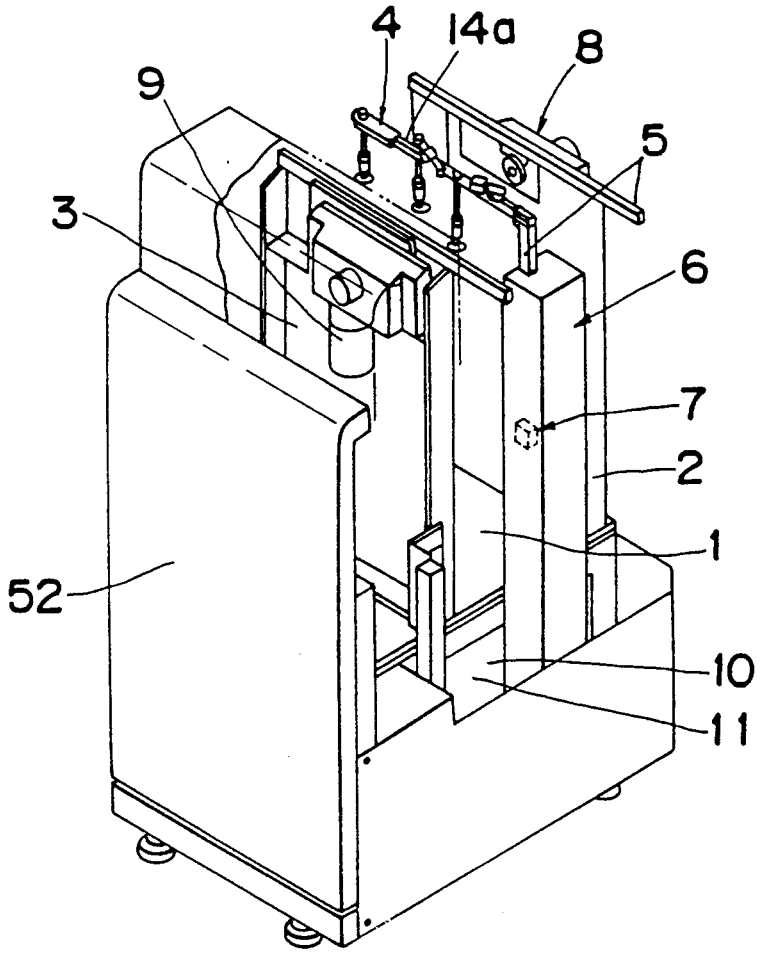
FIG. 1 is a perspective view showing a substrate supply apparatus according to an embodiment of the present invention.

Before the description of the present invention proceeds, it is to be noted that like parts are designated by like reference numerals throughout the accompanying drawings.

A substrate supply apparatus according to an embodiment of the present invention is described below with reference to FIGS. 1 through 6.

Referring to FIG. 1, the substrate supply apparatus comprises a substrate-accommodating section 1 including substrate-width-regulating sections 2 and 3. The substrate-width-regulating section 2 moves a different distance according to the size and configuration of a substrate on which electronic components are to be mounted so as to accommodate it in the substrate-accommodating section 1. The substrate supply apparatus further comprises: a substrate-sucking device 4 which is vertically moved by an elevating device 6; a sensor switch 7 for detecting the position of the substrate-sucking device 4; a transporting device 8, having a pair of rails 5, for transporting the substrate; a motor 9 for changing the distance between the rails 5; a width-adjusting device 10 for adjusting the width of the substrate-width-regulating sections 2 and 3; and a ½-width-adjusting device 11 for positioning the elevating device 6; and a front door 52. The width-adjusting device 10 and the ½-width-adjusting device 11 are disposed below the substrate-accommodating section 1.

Figure 2:
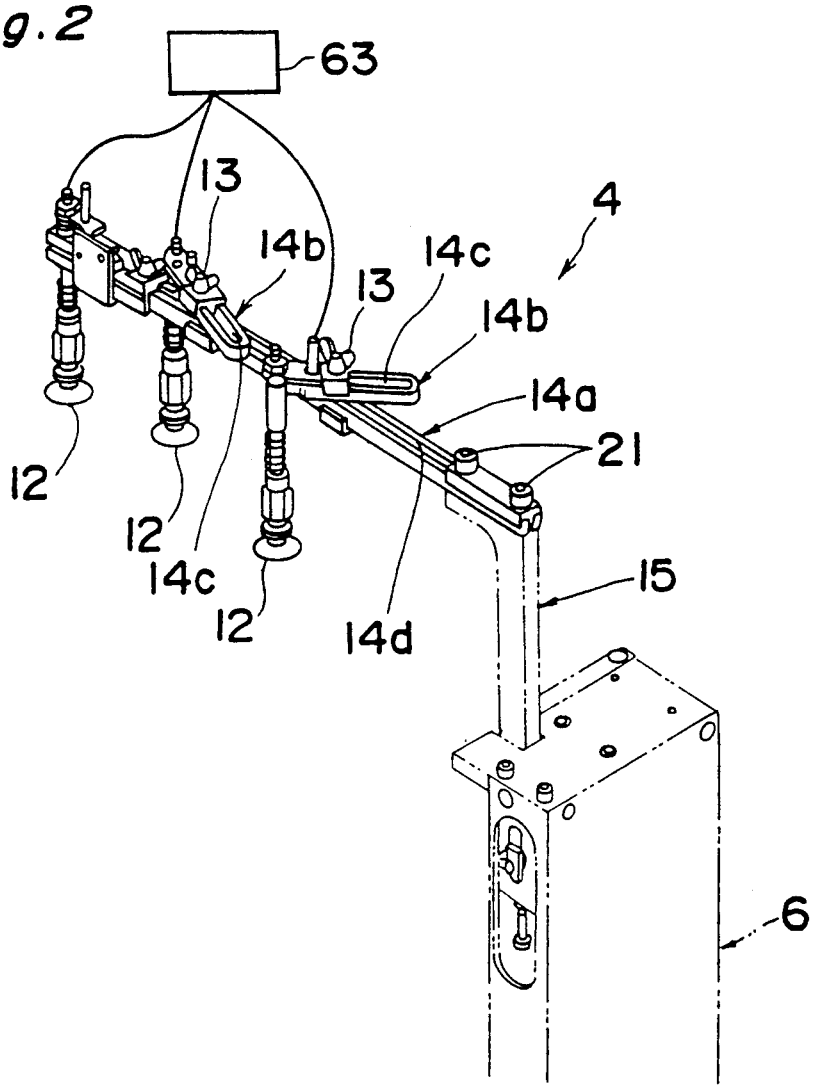
FIG. 2 is a perspective view showing the detailed construction of a substrate-sucking device.

Referring to FIG. 2 showing the detailed construction of the substrate-sucking device 4, a plurality of short substrate-sucking arms 14*b* is fixed to a long substrate-sucking arm 14*a* by thumbscrews 13. Each of the short substrate-sucking arms 14*b* and the long substrate-sucking arm 14*a* has a groove 14*c*, 14*d* elongated in its longitudinal direction. Each thumbscrew 13 passes through the grooves 14*c* and 14*d* and then can freely move in each groove 14*c*, 14*d* so that the short substrate-sucking arms 14*b* can be positioned at desired positions to the long substrate-sucking arm 14*a* by the thumbscrews 13. The long arm 14*a* is connected with a bracket 15 of the elevating device 6 by screws 21 so as to adjust the connecting position between the long arm 14*a* and the bracket 15. A sucking pad 12 having a sucking means not shown is mounted on the leading end of each short arm 14*b* and the long arm 14*a* to connect with a vacuum pump 63 to suck the substrate.

Figure 3A:
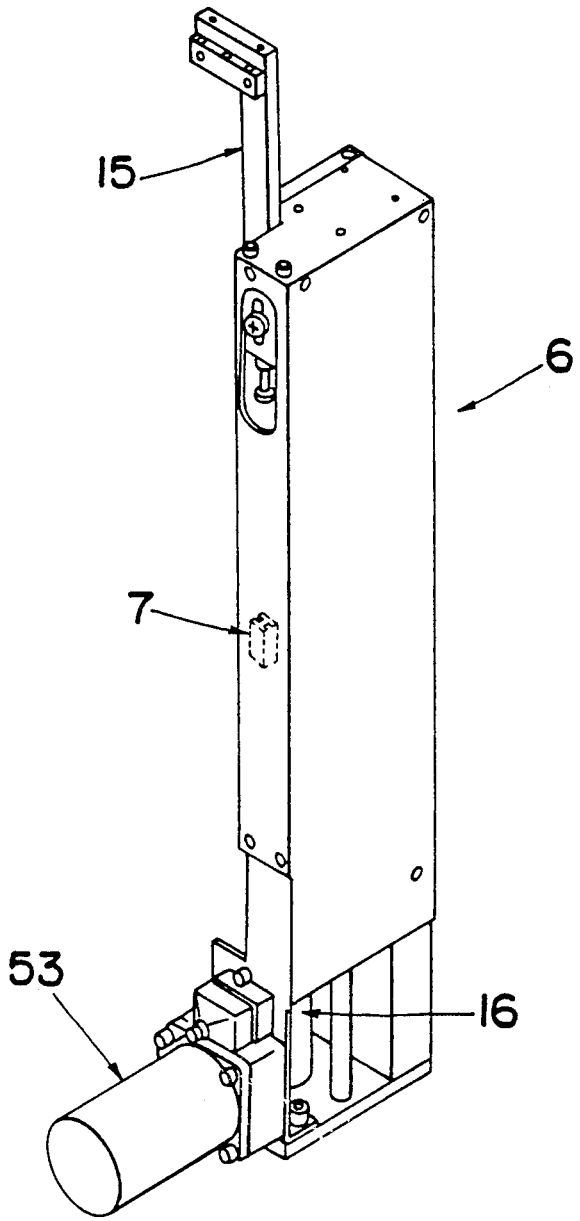
FIGS. 3A. and 3B are a perspective view and a cross-sectional view showing the detailed construction of an elevating device.
Figure 3B:
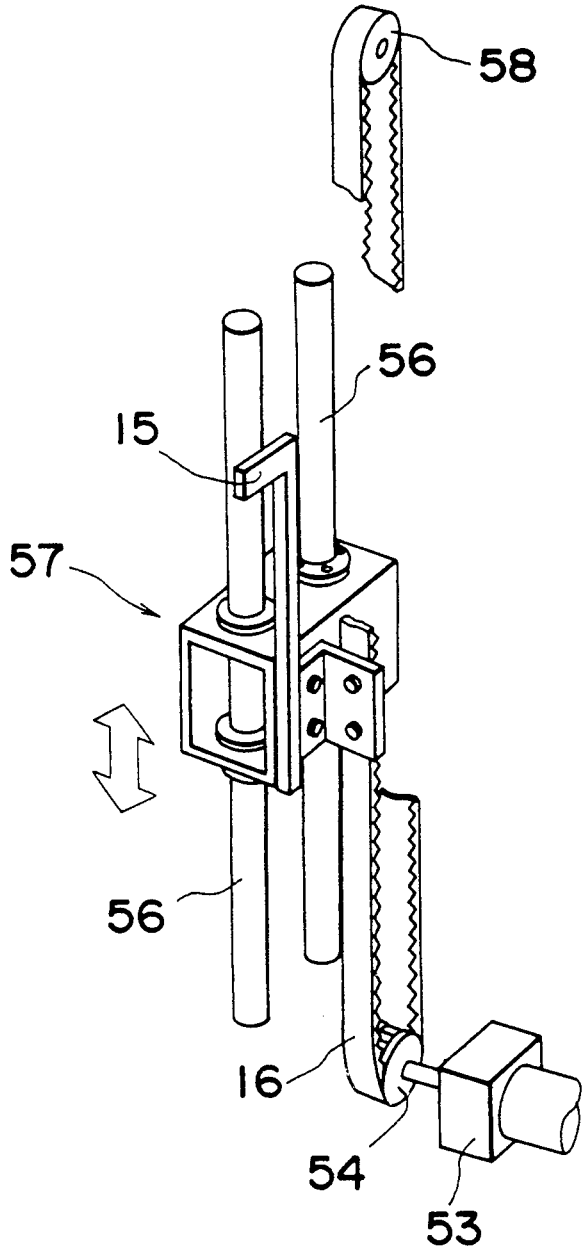

Referring to FIGS. 3A and 3B showing the detailed construction of the elevating device 6, the bracket 15 is driven through a timing belt 16 by a motor 53, thus moving vertically. That is, as shown in FIG. 3B, the belt 16 is engaged a driving pulley 54 fixed to a rotary shaft of the motor 53 and supported by a driven pulley 58 and is moved according to the rotation of the driving pulley 54 by the motor 53. A lift housing 57 is fixed to a portion of the belt 16 and is vertically guided by guide rods 56 to smoothly move the lift housing 57. The bracket 15 is fixed on the side surface of the lift housing 57. Then, according to the rotation of the driving pulley 54 by the motor 53, the belt 16 moves upward or downward together with the lift housing 57 to vertically move the bracket 15.

Figure 4:
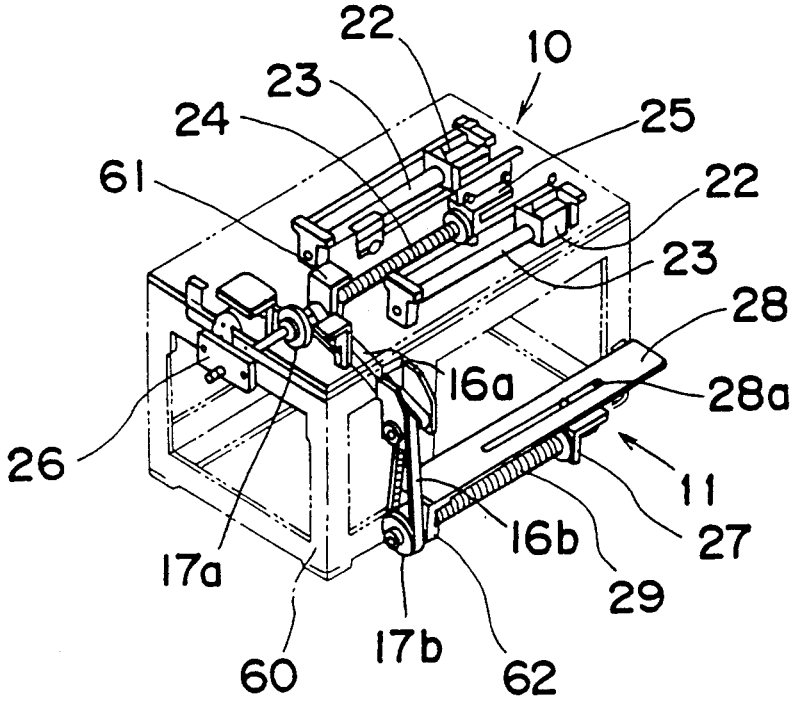
FIG. 4 is a perspective view showing the detailed construction of a width-adjusting device.

Referring to FIG. 4 showing the detailed construction of the width-adjusting device 10 connected with the substrate-width-regulating section 2 and that of the ½-width-adjusting device 11 connected with the elevating device 6. The width-adjusting device 10 and the ½-width-adjusting device 11 are connected with each other by belts 16*a* and 16*b* and pulleys 17*a* and 17*b*. The pulleys 17*a* and 17*b* have diameters so that the shaft of the ½-width-adjusting device 11 rotates 180° per rotation of the shaft of the width-adjusting device 10. In the width-adjusting device 10, the pulley 17*a* is rotatably supported by a bracket 61 fixed to a casing 60. The pulley 17*a* is fixed to one end of a first rod 24 to rotate together with the first rod 24. A bracket 25 connected with the lower portion of the substrate-width-regulating section 2 has a hole with an inner screw for engaging the outer screw of the first rod 24 to constitute a ball screw. Then, the rotation of the first rod 24 allows the bracket 25 to move along the first rod 24. The lower portion of the substrate-width-regulating section 2 are also connected with guide brackets 22 movable along guide rods 23 fixed on the casing 60. The end of the first rod 24 which penetrates the pulley 17*a* is fixed to a handle 26. Then, an operator can rotate the first rod 24 by the handle 26 to move the substrate-width-regulating section 2 in the width direction of the substrate through the bracket 25, and the guide brackets 22 along the guide rods 23 for adjusting the width of the substrate-width-regulating sections 2 and 3. At this time, the rotation of the pulley 17*a* allows the pulley 17*b* to rotate through the belts 16*a* and 16*b*. In the ½-width-adjusting device 11, the pulley 17*b* is rotatably supported by a bracket 62 fixed to the casing 60. The pulley 17*b* is fixed to one end of a second rod 29 to rotate together with the second rod 29. A bracket 27 connected with the lower portion of the elevating device 6 has a hole with an inner screw for engaging the outer screw of the second rod 29 to constitute a ball screw. Then, the rotation of the second rod 29 allows the bracket 27 to move along the second rod 29. The bracket 27 moves in the same direction as the substrate-width-regulating section 2 while being guided by a guide groove 28*a* of a guide plate 28 fixed to the casing 60. Then, when the pulley 17*b* rotates together with the second rod 29 according to the rotation of the pulley 17*a*, the elevating device 6 moves in the width direction through the second rod 29 and the bracket 27. Thus, the elevating device 6 is positioned in the center of the substrate in the width direction thereof by adjusting the position of the movable substrate-width-regulating section 2 according to the width of the substrate. The width-adjusting device 10 is operated by manually rotating the handle 26 of the ball screw in this embodiment, but may be automatically operated by a motor connected therewith.

Figure 5A:
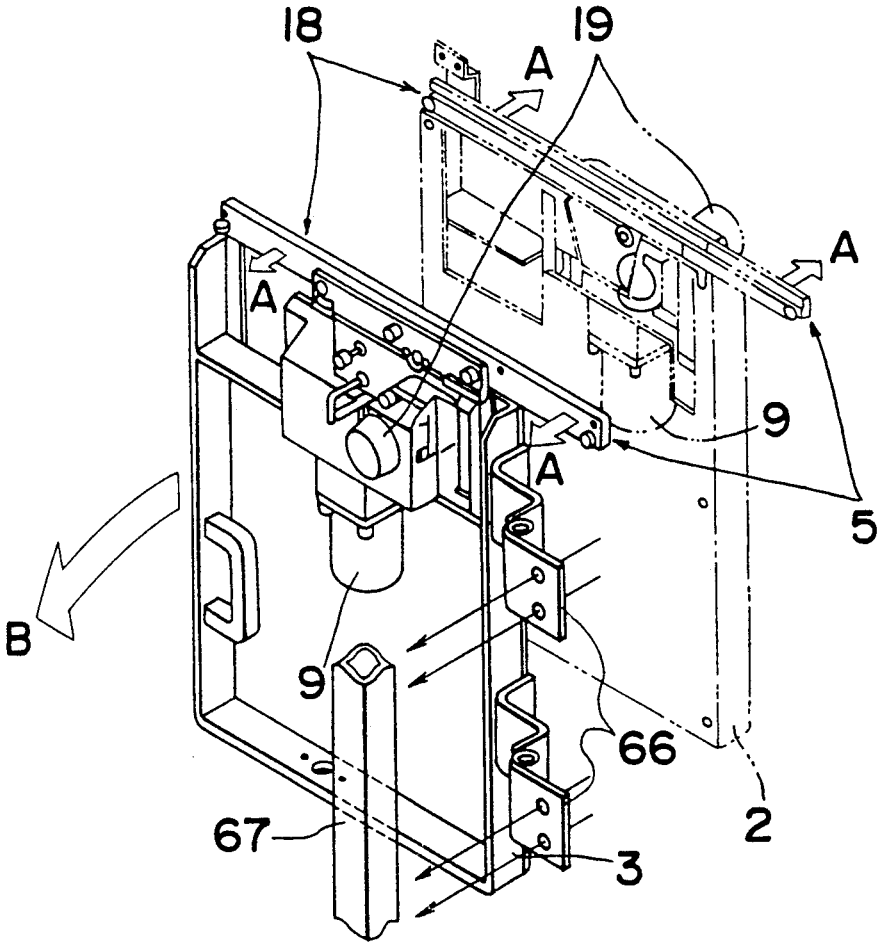
FIGS. 5A and 5B are a perspective view and a partially enlarged perspective view showing the detailed construction of a transporting device.
Figure 5B:
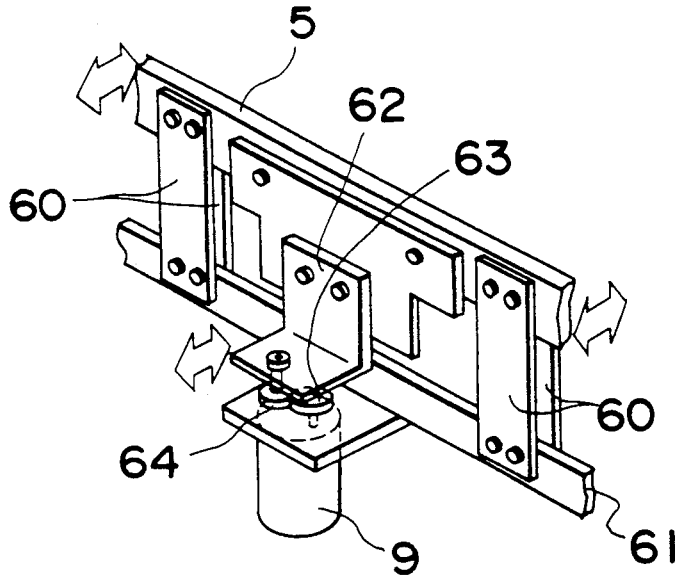
Figure 5C:
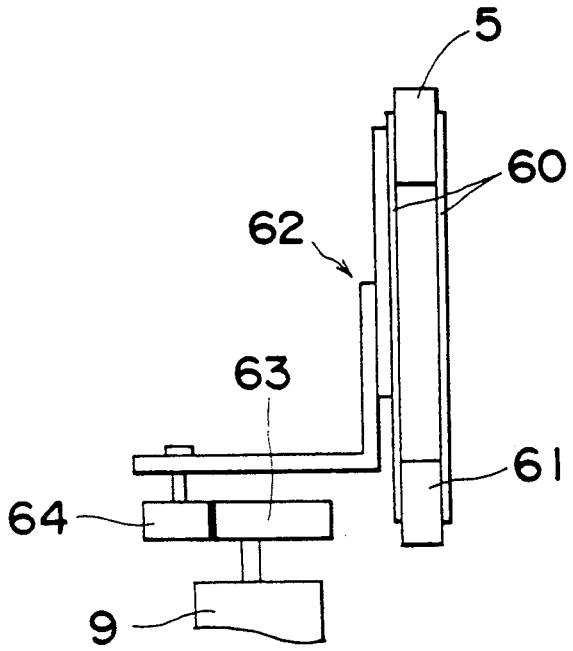
FIGS. 5C and 5D are schematical side views showing the transporting device.
Figure 5D:
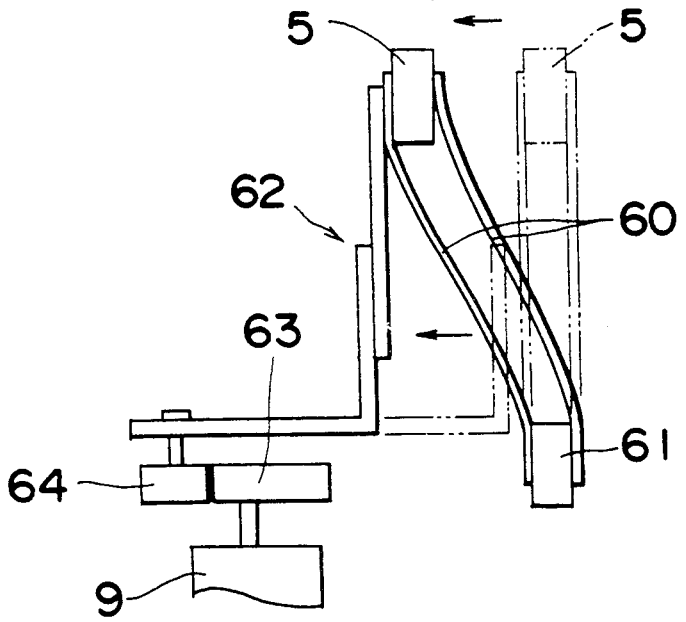

Referring to FIGS. 5A through 5D showing the detailed construction of the transporting device 8, the rails 5 is each provided with a belt 18 which is driven by a motor 19. The rails 5 transport the substrate placed on the belt 18. The substrate-width-regulating section 3 is secured to a frame rectangular column 67 of a base of the apparatus by hinges 66 disposed at a side portion thereof and is opened in the direction shown by an arrow (B) together with the front door 52 so that the substrate-width-regulating section 3 receives the substrate and supplies it to the substrate-accommodating section 1. Each rail 5 is flexibly supported by four flat springs 60 on a fixed frame 61 to be capable of flexibly moving along an arrow (A) against to the fixed frame 61. The upper portion of an L-shaped bracket 62 is fixed to each rail 5 and the lower surface thereof rotatably supports a cam follower 64. The cam follower 64 contacts a cam 63 fixed to a rotary shaft of the motor 9 so that the cam follower 64 and the rail 5 can move reciprocally and linearly in accordance with the urging force of the four flat springs 60. Thus, when the motor 9 rotates the cam 63 so that the cam 63 presses the cam follower 64, in FIG. 5D, the leftward movement of the cam follower 64 and the bracket 62 causes the rail 5 to leftward move along the arrow (A) through the springs 60 against the fixed frame 61 which does not move. Then, the rails 5 are moved to widen the distance between the rails 5 in the direction shown by the arrows (A) so that the substrate 20 can move upward between the rails 5. On the other hand, when the motor 9 further rotates the cam 63 to release the pressing of the cam follower 64, in FIG. 5D, the cam follower 64 moves rightward while the cam follower 64 contacts the cam 63 by the urging force of the springs 60. Then, the rightward movement of the cam follower 64 and the bracket 62 causes the rail 5 to rightward move along the arrow (A) through the springs 60 against the fixed frame 61 to return to its original position as shown in FIG. 5C. Then, the rails 5 are moved to reduce the distance between the rails 5 in the direction shown by the arrows (A).

The operation of the substrate supply apparatus having the above-described construction is described below.

The front door 52 and the substrate-width-regulating section 3 are opened to accommodate the substrate 20 in the substrate-accommodating section 1. The width of the substrate-width-regulating sections 2 and 3 is adjusted according to the size and configuration of the substrate 20. At this time, as shown in FIG. 6, the elevating device 6 is positioned at the center between the rails 5 by the operation of the ½-width-adjusting device 11 interlocked with the width-adjusting device 10.

Figure 6:
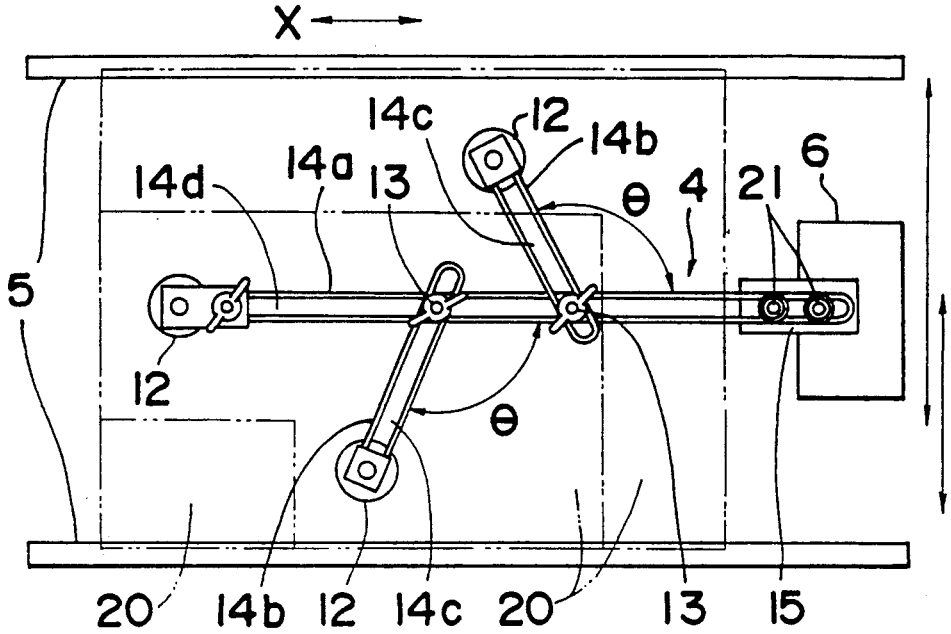
FIG. 6 is a perspective view showing the arrangement of arms on a sucking device.
Figure 7:
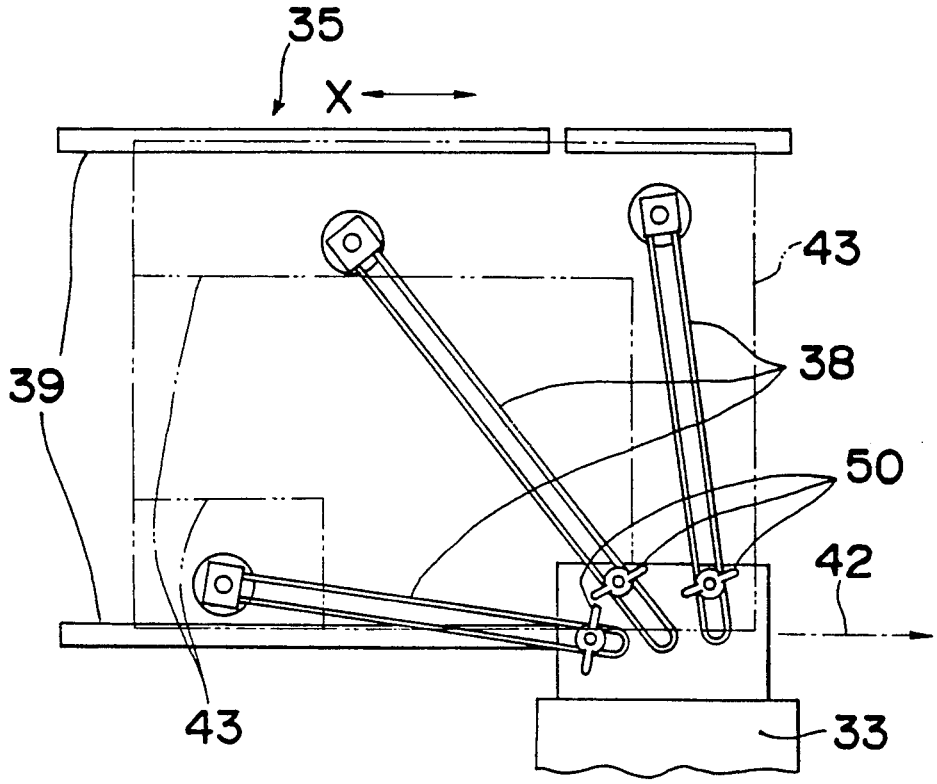
Fig. 7 PRIOR ART
FIG. 7 is a plan view showing the arrangement of arms of a conventional sucking device in a conventional substrate supply apparatus.
Figure 8:
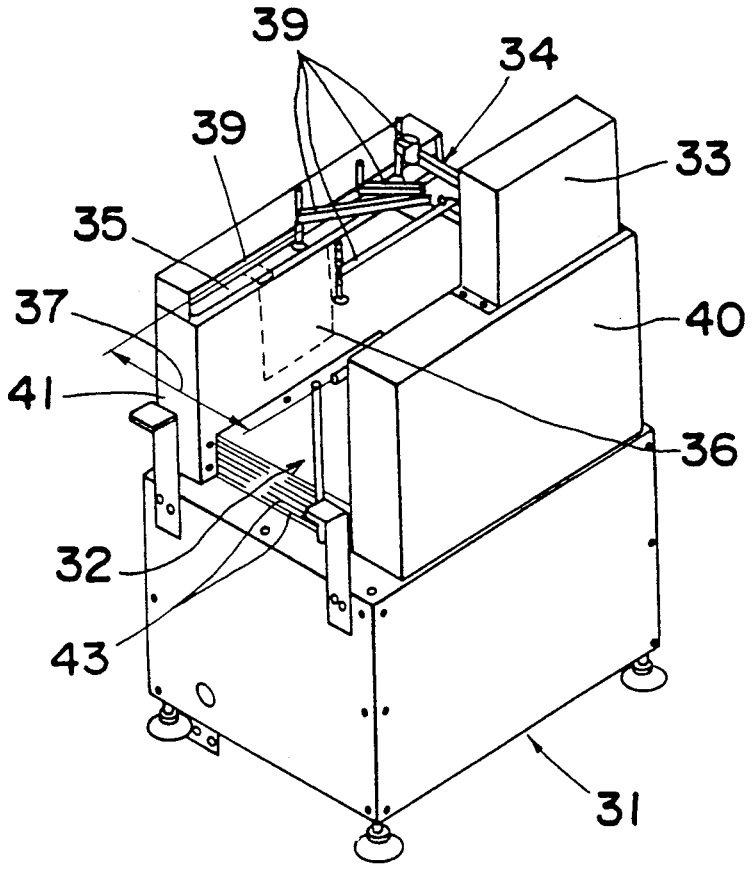
Fig. 8 PRIOR ART
FIG. 8 is a perspective view showing the apparatus in FIG. 7.

As shown in FIG. 6, according to the size and configuration of the substrate, the short arms 14*b* can be position-changeably fixed to the long arm 14*a* by the thumbscrews 13. The long arm 14*a* is located at the center between the rails 5, so that the short arms 14*b* are installed on the long arm 14*a* like branches on the upper and/or lower sides of the long arm 14*a* in FIG. 6. Therefore, the short arms 14*b* are allowed to pivot in a large angle without interfering with each other. In addition, the length of the long arm 14*a* and the short arms 14*b* can be altered depending on the size and configuration of the substrate. Since the short arms 14*b* can be position-changeably installed on the long arm 14*a*, the substrate-sucking device 4 is capable of sucking substrates 20 of various configurations and sizes.

The flexure and installation accuracy of the short arms 14*b* do not greatly affect the height of the leading end thereof and effectively prevent the heights of the sucking pads 12 from being different from each other. Therefore, erroneous sucking of the substrate 20 can be reduced.

After the positioning of the elevating device 6 is completed, the elevating device 6 moves the substrate-sucking device 4 downward so that the pads 12 suck the substrate 20 by suction force and then, moves the substrate-sucking device 4 upward. At this time, the motor 9 and the cam 63 operate to open, namely, widen the distance between the rails 5 in the direction shown by the arrows (A) so that the substrate 20 can move upward between the rails 5. Thereafter, the width between the rails 5 is reduced, namely, closed. When the substrate-sucking device 4 has placed the substrate 20 on the rails 5, the belt 18 operates, thus transporting the substrate 20 to the left horizontally in FIG. 6 in an X-direction.

Since the substrate-sucking device 4 is disposed in the middle between the rails 5, it is possible to extend the rails 5 to the right in FIG. 6 so as to connect the substrate supply apparatus with an adjacent apparatus, receive a substrate transported therefrom, and then transport the substrate to an electronic component-mounting apparatus in the left direction. In order to perform this operation, the substrate-sucking device 4 is moved to a position below the rails 5 by the elevating device 6 with the sensor switch 7 utilized while the substrate is passing through the rails 5.

According to the substrate supply apparatuses of the embodiment, the short sucking arms are position-changeably installed on the long arm and in addition, the length of the short sucking arms can be varied according to the size and configuration of the substrate. Therefore, the short sucking arms are enabled to pivot a great angle and thus do not interfere with each other. Thus, an erroneous sucking of the substrate can be reduced compared with conventional substrate supply apparatuses. It is possible to extend the transporting rails in the right and left directions to connect the substrate supply apparatus with an apparatus in one direction and an electronic component-mounting apparatus in the other direction so that the substrate supply apparatus can receive a substrate transported from the apparatus in one direction and transport the substrate to the electronic component-mounting apparatus.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A substrate supply apparatus comprising:

a substrate-accommodating section for accommodating a substrate on which electronic components are to be mounted, the substrate-accommodating section having substrate-width-regulating sections a distance between which can be adjusted in a width direction of the substrate;

a substrate-width-adjusting means for adjusting the distance between the substrate-width-regulating sections by moving one of the substrate-width-regulating sections in the width direction;

a transporting means, supported by the substrate-width-regulating sections, having a pair of rails, and arranged above the substrate-accommodating section, for transporting the substrate to an electronic component-mounting apparatus;

a substrate-sucking means having a long substrate-sucking arm and a plurality of short substrate-sucking arms, each of the substrate-sucking short arms being position-changeably installed on the long substrate-sucking arm; and an elevating means for supporting and vertically moving the substrate-sucking means so that the substrate-sucking means transfers the substrate to the transporting means, the elevating means being disposed at a center of a space between the pair of rails in the width direction.

2. The substrate supply apparatus as claimed in claim 1, wherein one end of the long substrate-sucking arm is position-changeably installed on the elevating means.

3. The substrate supply apparatus as claimed in claim 1, further comprising a width-adjusting means, operably connected with the substrate-width-adjusting means, for positioning the elevating means at the center of the space of the substrate-accommodating section in the width direction in unison with an operation for adjusting the distance between the substrate-width-regulating sections of the substrate-accommodating section to a width corresponding to that of the substrate.

* * * * *